United States Patent [19]

Samford

[11] 4,285,410

[45] Aug. 25, 1981

[54] BROACH FOR INCORPORATION IN A DRILL STRING

[76] Inventor: Travis L. Samford, 6110 Elmgrove, Spring, Tex. 77379

[21] Appl. No.: 74,159

[22] Filed: Sep. 10, 1979

[51] Int. Cl.[3] ..... E21C 17/00

[52] U.S. Cl. ..... 175/394; 175/406; 175/410

[58] Field of Search ..... 175/323, 325, 394, 409, 175/410, 406

[56] References Cited

U.S. PATENT DOCUMENTS

| | | | |
|---|---|---|---|
| 2,572,839 | 10/1951 | McClinton | 175/394 |
| 2,869,828 | 1/1959 | McClinton | 175/323 X |
| 2,888,845 | 6/1959 | McClinton | 175/406 X |
| 3,085,639 | 4/1963 | Fitch | 175/323 |
| 3,480,094 | 11/1969 | Morris | 175/325 |
| 3,754,609 | 8/1973 | Garrett | 175/325 X |
| 3,825,083 | 7/1974 | O'Dell et al. | 175/394 |

*Primary Examiner*—James A. Leppink

*Attorney, Agent, or Firm*—Gunn, Lee & Jackson

[57] ABSTRACT

An improved broach is disclosed incorporating, in the preferred and illustrated embodiment, an elongate tubular member constructed in the fashion of a drill collar having a raised external thread cut thereon in helical fashion, the thread having a top face. The thread tapers from the bottom to a maximum diameter at a very gradual rate. The top face includes a generally flat, exposed surface which is reinforced with particulate tungsten carbide. It additionally includes inserts of tungsten carbide at periodic locations as, for example, inserts located at ninety-degree intervals along the thread face. The inserts extend relatively deep and are constructed of a solid block of tungsten carbide in a supportive alloy. Another form has inserts made of cylindrical pellets.

7 Claims, 4 Drawing Figures

FIG. 1
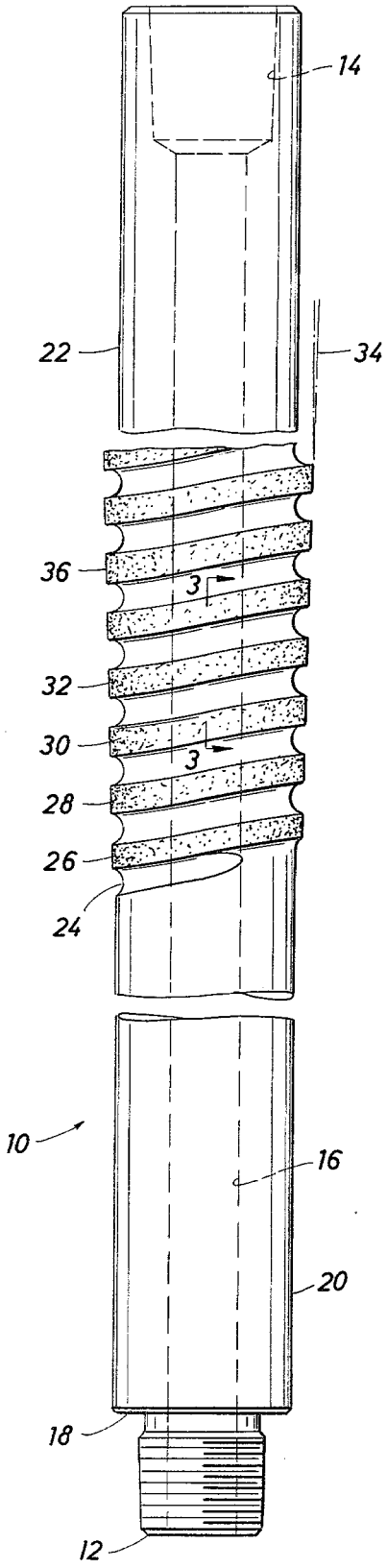
FIG. 2
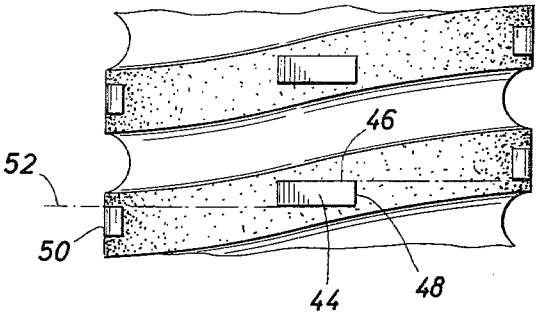
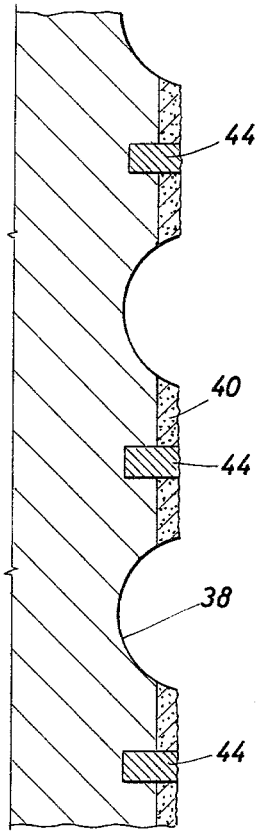
FIG. 3
FIG. 4
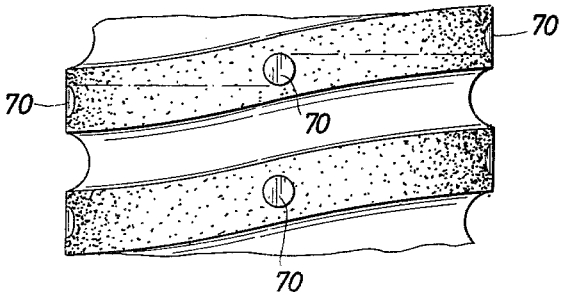

BROACH FOR INCORPORATION IN A DRILL STRING

BACKGROUND OF THE DISCLOSURE

In drilling an oil well, the hole will drift somewhat from the true vertical reference normally intended for the path of the well. As it drifts, the deviation from the vertical causes the drill string to bear against the sidewall. When this occurs, the extra drag wears on the drill string. It runs the risk of differential pressure sticking. Moreover, drifting holes sometimes form what is called a "key seat." A key seat is a round hole which is originally cut by operation of the drill bit which has been cut at one side by rubbing from the drill string to form an opening which resembles, in cross section, a keyhole.

Most drill strings are drilled with externally upset drill pipe, the external upsets occasionally hanging in the key seats. The present invention is an enhanced version of apparatus which, placed in a drill string, enlarges the hole where rubbing occurs between the drill string and a key seat. It includes a type of drill collar with an external helical thread cut on it with the edges of the thread shaped to cut a portion of the key seat away, thereby enlarging the key seat area. This enables the broach of the present invention to reshape the drilled hole. As the drill string is rotated, the broach cuts into constrictions impeding rotation and penetration of the drill string. The broach incorporates a helical thread formed on it with a slightly raised, hard metal reinforced crown on the thread which cuts into the hole, thereby enlarging it. To the extent the hole is straight, the broach does not cut. Rather, it cuts only where the drill string must pass through a constriction or drags against the well bore.

BRIEF SUMMARY OF THE DISCLOSURE

The broach of the present invention incorporates a raised thread which is formed of hardfacing metal. Hardfacing metal is distributed reasonably uniformly over the face, and the face is further reinforced periodically, the additional reinforcing having the form of large inserts which are anchored to the broach in the crown of the thread and which provide deep rooted reinforcing to the hardfacing metal. This kind of construction extends the life of the broach. It will be understood that the broach is exposed to very abrasive wear and tear as drilling proceeds and wears away during its use. The construction taught in this disclosure extends the life markedly and enables the broach to operate for a longer period of time. The reinforced crown of the thread thus serves as a sacrificial abrasive work area. While it is sacrificial, it, nevertheless, has a great life and, in particular, is able to withstand the abrasion of the well bore in which it is used while lasting a long period of time. This enables the broach to be used in drilling many wells dependent on the rate of wear.

One of the advantages of the present invention is that the broach is tapered at the threads. The first thread, or, more accurately, the bottommost first helical turn of the thread, is smaller in radial extent than the next thread. This taper extends up the broach until a maximum diameter is achieved. This enables the broach to enter a key slot and begin cutting. Moreover, wear is distributed along the tapered thread. While the first turn of the thread may cut partly through a key slot, the second and all subsequent turns also do significant cutting through the key slot.

One important feature of the present invention is the durability obtained by this apparatus. The hardfacing which is described in this disclosure is periodically reinforced with the installation of large inserts of abrasive material. The large inserts are spaced periodically along the length of the apparatus, and they have the form of replaceable plugs or inserts. In the preferred embodiment, they have a rectangular face, being received in a receptacle cut to a specified depth and adequate to carry the brunt of the wear. As wear accumulates, the plug or insert can be removed and replaced. This procedure can be implemented in the field as, for example, by attaching the insert through brazing. The insert is plugged into an appropriately shaped opening formed in the broach at the time of fabrication and is fastened by brazing. It can be removed by heating to a suitable temperature, removing the partially worn insert and replacing it with a fresh insert secured in position by brazing. An alternate form includes a cylindrical plug positioned in a hole drilled for the plug.

The present invention is, therefore, summarized as a hole enlarging broach having the form of a drill collar with an external thread formed on it. The external thread has the form of a helical thread extending the length of the broach and is smaller at the lower end. The thread begins at a smooth external surface which conforms with the diameter of drill collars in the drill string. The thread enlarges so that the crown of the thread extends radially outwardly beyond the radial measure of the lower portion of the broach. The slightly larger thread portion which tapers to the enlarged threads cuts the adjacent well bore to free the drill string of key seats. The drill string is, therefore, able to cut the hole by abrading it as the drill string is rotated, positioning the raised crown of the thread against the well bore. The thread includes a top face at the crown which is formed of hardfacing metal and which includes recessed plugs or inserts at spaced locations as, for instance, every ninety degrees in the preferred embodiment. The inserts have the form of hardfacing material received in a receptacle cut into the body of the broach before assembly. The plug which is positioned in the hole can be replaced by detaching it and subsequently replacing it with a full gauge plug or insert. In the preferred embodiment, the insert has the form of a rectangular metal body. An alternate is cylindrical plugs.

BRIEF DESCRIPTION OF THE DRAWINGS

While the foregoing is directed to a summary of the apparatus, the construction of the structure is disclosed in the drawings which are attached and wherein:

FIG. 1 shows in side view the improved broach of the present invention;

FIG. 2 is an enlarged partial view showing how the threads are constructed and, in particular, illustrating incorporation of a plug which reinforces the crown of the helical thread;

FIG. 3 is a sectional view along the line 3—3 of FIG. 1 showing a cross-sectional view of the thread formed on the exterior of the broach; and FIG. 4 discloses an alternate form of thread reinforcing apparatus.

DETAILED DESCRIPTION OF THE ILLUSTRATED EMBODIMENT

Attention is first directed to FIG. 1 of the drawings, where the numeral 10 identifies the improved broach of the present invention. It is constructed somewhat in the fashion of a drill collar. To this end, it includes a pin 12 at the lower end which has a set of threads constructed in accordance with an industry standard to threadedly connect in a drill string. The drill string extends below the broach 10 and also extends above the broach. This connection is achieved through the use of a box connection 14 at the upper end. The pin and box define threaded connectors which assist in installation of the broach. The broach has a thick wall body portion around an axial passage 16 which connects between the pin and box to enable mud to flow through the broach. It is connected serially in a drill string. It also includes a fairly thick wall 18 which adds weight to the drill string and maintains the broach 10 rigid and aligned with the remainder of the drill string. The broach 10 thus has a smooth external wall 20 on the lower portions which has the same diameter as drill collars located below the broach.

The external wall 20 is also found at 22 at the upper portions of the tool and has an equal diameter. Between the lower and upper portions where a uniform diameter is displayed, the apparatus includes a set of threads as will be described. The lowermost portion of the threaded portion includes a groove 24 adjacent to a first turn 26. The groove 24 is located between adjacent turns of the thread. The first helical turn 26 becomes the second helical turn 28. The thread extends to the third turn 30, and the fourth turn is identified at 32. The several turns are cut at a uniform pitch. The groove between the raised crowns of the thread is uniform in width, the thread having a uniform pitch along the broach 10.

The first helical turn extends above the surface 20. The second helical turn 28 is somewhat taller. The third and fourth turns are also taller. The several turns of the helical thread are constructed along a taper, the line 34 identifying the angle of taper. The first several turns of the thread, a selected number in the range of about four to ten turns, are constructed with everincreasing height. The last several threads above the thread 36 have a uniform height. That is to say, they are larger by a uniform measure compared with the diameters 20 and 22. The taper of the preferred form is about one-eighth inch per foot of length. A larger taper of one-quarter inch per foot is acceptable. The thread pitch is about two to eight threads per foot. The groove is cut about one-fourth to one-half inch deep.

For a better understanding, attention is directed to FIG. 3, where the numeral 38 identifies the valley or groove cut between adjacent crowns, and it will be observed that a circular profile is adequate. While a different profile can be achieved as exemplified by Acme threads, a curve constructed more or less as a segment of a circle is advantageous in that trash and cuttings can be flushed from the groove and carried away by mudflow through the broach in the annular space on the exterior during drilling. The radius of curvature at 38 avoids sharp corners. Because there are no sharp corners, the crown which stands above the root of each thread is supported on adequate metal, and, being devoid of sharp corners, stress concentrations are avoided. The absence of sharp corners at the root of each crown enhances the strength and avoids chipping or breaking off portions of the thread on the exterior of the broach.

Each helical turn of the thread is first cut on a blank, and, thereafter, hardfacing material at 40 is applied fairly uniformly across the width of the crown. The crown is thus covered over by depositing tungsten carbide particles in an alloy matrix serving as a support or base metal, this material being applied across the width fairly uniformly and to a relatively uniform depth. A suitable depth is in the range of about one-eighth inch. The application of the hardfacing material is preferably carried out after the thread is formed. The material is applied by first heating the partially finished broach and thereafter applying the tungsten carbide and supportive matrix material to the crown of the thread.

The thread which is incorporated has a relatively slight lead. A single thread is preferably used, although a double-lead thread can be formed. In any event, the fabrication of a single or double-lead thread will suffice as long as the crown is reinforced with the hardfacing material. The preferred material described above is applied fairly uniformly across the crown. Inasmuch as each turn of the screw which is formed on the exterior stands slightly taller, it will be understood how wear is distributed from the smallest turn to the larger turns, namely, from the bottommost turn 26 to the other turns 36.

The present invention utilizes inserts 44 at spaced locations along the thread. The inserts 44 are constructed of rectangular stock which is a solid body of hardfacing material in a supportive matrix. Again, tungsten carbide particles ground to a particular size are supported in a suitable alloy to form a rectangular block or body. The rectangular block or body is received within a recess formed in the broach at the crown of the thread with dimensions adequate to receive the insert. The insert is anchored in the receptacle or formed hole by brazing. This preferred method of attachment requires that brazing material be placed in the hole, and the area is then heated to a temperature sufficient to melt the brazing material to thereby metallically attach the insert in the hole. A friction fit can be used, but this requires rather precise machining.

The insert has the form of a small rectangular block standing sufficiently tall to extend below the layer of hardfacing 40. It is shown in FIG. 2 of the drawings, where the long dimension 46 is transverse to the centerline axis of the tool. The width dimension is smaller. The relative ratio is about 3:1. It is helpful to position the long dimension 46 perpendicular to the centerline axis of the tool. The insert or plug, being rectangular in the preferred form, is located in each helical turn along the tool. This is particularly advantageous in the tapered threads which all bear some of the wear during use. Moreover, a large number of inserts are used, the preferred embodiment positioning the inserts 44 at approximately ninety-degree intervals around the tool. Accordingly, one full turn of the thread supports four inserts. They are, therefore, arranged immediately adjacent above other inserts so that there is a column of inserts as shown in FIG. 2. In actuality, the preferred embodiment incorporates four columns of inserts.

In FIG. 2 of the drawings, the insert 44 is offset from the insert 50. The insert 50, however, is positioned so that it does not leave a gap, noting the reference line 52. The line 52 is coextensive with the top edge 46 of the insert 44. The insert 50 is located at that reference line 52 and extends thereabove. Progressing from the top to the bottom of the thread, the several inserts thus all protect the thread against wear in that adjacent inserts are positioned so that there is at least some overlap between them. While a precise measure of overlap is not required, it is advantageous that they conform to the reference line 52, and, indeed, overlapping whereby the insert 50 extends below the line 52 is certainly permissible. Provision of overlap extends the life of the broach. Moreover, even after the hardfacing material 40 is worn away, the inserts 44 remain to shoulder the additional wear which is inflicted on the tool. The wear manifests itself by abrading and rubbing against the crown of the thread, wearing away the hardfacing 40 until the softer metal below is exposed. Wear, however, does not accelerate to such an extent after the hardfacing 40 is cut away. The inserts 44 are there to protect the remaining portions of the tool to limit wear and thereby enable the tool to last substantially indefinitely. Even after wear has accumulated to a very great extent, the inserts can be removed and replaced to extend the life of the apparatus.

The inserts 50 thus have a slightly curved, arcuate top face so that they do not protrude at their corners when joined to the cylindrical broach and are positioned in a recess in the curved top face. Moreover, the inserts 50 can be constructed with a slight taper so that they easily plug into the openings which are formed for them preliminary to brazing or attachment.

The present invention includes a goodly number of turns. Since the rate of penetration is relatively slow even in the fastest of drilling, and since the lead of the thread is relatively slight, enlargement of the hole in which the broach is used occurs relatively slowly. While it may be slow, it is sufficient to avoid dangerous key seating. Moreover, as it cuts into the key seat, the flow of drilling mud through the annular space clears and lubricates the cutting which occurs.

After the device has been used until a great deal of wear has accumulated, it is redressed and made like new. The worn inserts 44 are removed and are replaced with new inserts as, for instance, by brazing. Braze metal can be placed in the receptacle and the insert pushed into it, and the entire tool can thereafter be heated to a sufficient temperature to complete the braze connection. Separate and apart, the hardfacing 40 is replaced by depositing a layer of specified thickness of tungsten carbide particles in a supportive alloy. The supportive alloy is a carrier which supports the particles. FIG. 4 discloses an alternate form including a round or cylindrical plug insert 70 of tungsten carbide in an alloy which is friction-fitted into a tight cylindrical opening made for it. The insert is spaced vertically to assure overlap along the tool length. Brazing for attachment is permissible.

Many alterations and variations can be incorporated in this structure, but the scope of this disclosure is determined by the claims which follow.

I claim:

1. A broach for cutting a well bore to enlarge the opening thereof which comprises:

(a) an elongate, hollow, tubular body having threaded end connections thereon constructed in accordance with an industry standard to communicate an axial passage through said tubular body and wherein said passage is adapted to receive mudflow therethrough with said tubular body installed in a drill string; and (b) an external thread formed on said tubular body, said external thread incorporating multiple helical turns around said tubular body wherein the lowermost turn is larger in diameter than the diameter of said tubular member and wherein the turns thereabove are progressively larger and define a threaded taper terminating at an uppermost turn of largest diameter, the turns being comprised of a crown adjacent to a groove and the crown including an outer exposed face made of hardfacing material across at least a portion of the outer face, said crown and said hardfacing material defining a plurality of insert recesses extending to a substantial depth within said crown, and said external thread further including periodically placed inserts located within said insert recesses and extending through said hardfacing material and having a major portion thereof positioned beneath said hardfacing material, and inserts having an exposed outer surface in the outer face wherein said inserts are formed of a hardfacing material and said inserts are located at spaced locations along the crown of said thread.

2. The apparatus of claim 1 wherein said inserts have rectangular bodies with an outer face arcuately curved at a radius to enable the outer face to conform with the exposed outer face of said thread, and further wherein said inserts have a long dimension enabling said inserts to be positioned with the long dimension perpendicular to the centerline of said tubular body.

3. The apparatus of claim 2 wherein said inserts are positioned relative to one another so that adjacent inserts overlap one another along the length of said tubular body.

4. The apparatus of claim 1 wherein said inserts are cylindrical, having an edge arranged at a specified elevation relative to the length of said tubular body, and are positioned relative to one another so that adjacent inserts overlap one another along the length of said body.

5. A broach for cutting a well bore to enlarge the opening thereof which comprises:

(a) an elongate, hollow, tubular body having threaded end connections thereon constructed in accordance with an industry standard to communicate an axial passage through said tubular body and wherein said passage is adapted to receive mudflow therethrough with said tubular body installed in a drill string; and (b) an external thread formed on said tubular body, said external thread incorporating multiple helical turns around said tubular body wherein the lowermost turn is larger in diameter than the diameter of said tubular member and wherein the next turn thereabove is larger than the lowermost turn such that a selected number of turns taper to a maximum turn diameter, the turns being comprised of a crown adjacent to a groove and the crown including an outer exposed face made of hardfacing material across at least a portion of the outer face, said thread being formed with a plurality of recesses therein and said thread further including periodically placed inserts attached within said recesses and having an exposed outer surface in the outer face wherein said inserts are formed of a hardfacing material and said inserts are located at spaced locations along the crown of said thread, said inserts having bodies of rectangular configuration with an outer face arcuately curved at a radius to enable the outer face to conform with the exposed outer face of said thread, and further wherein said inserts have a long dimension enabling said inserts to be positioned with the long dimension perpendicular to the centerline of said tubular body.

6. The apparatus of claim 5 wherein said inserts are positioned relative to one another so that adjacent inserts overlap one another along the length of said tubular body.

7. A broach for cutting a well bore to enlarge the opening thereof which comprises:

(a) an elongate, hollow, tubular body having threaded end connections thereon constructed in accordance with an industry standard to communicate an axial passage through said tubular body and wherein said passage is adapted to receive mud-flow therethrough with said tubular body installed in a drill string; and (b) an external thread formed on said tubular body, said external thread incorporating multiple helical turns around said tubular body, the turns being comprised of a crown adjacent to a groove and the crown including an outer exposed face made of hardfacing material across at least a portion of the outer face and further including periodically placed inserts having an exposed outer surface in the outer face wherein said inserts are formed of a hardfacing material and said inserts are located at spaced locations along the crown of said thread, said inserts being of rectangular configuration, having an edge arranged at a specified angle relative to the length of said tubular body, and are positioned relative to one another so that adjacent inserts overlap one another along the length of said body.

* * * * *